United States Patent [19]

de la Villefromoy et al.

[11] Patent Number: 5,033,125

[45] Date of Patent: Jul. 23, 1991

[54] ADJUSTABLE WAIST GARMENTS

[75] Inventors: Kim de la Villefromoy; Timothy P. Grubi, both of Hackensack, N.J.

[73] Assignee: Chef Clothing Revival U.S.A. Inc., Paramus, N.J.

[21] Appl. No.: 553,899

[22] Filed: Jul. 16, 1990

[51] Int. Cl.[5] ..... A41D 1/06

[52] U.S. Cl. ..... 2/237; 2/76; 2/221

[58] Field of Search ..... 2/219, 220, 221, 232, 2/233, 235, 236, 237, 76, 227

[56] References Cited

U.S. PATENT DOCUMENTS

| | | | |
|---|---|---|---|
| 757,701 | 4/1904 | Wheless | 2/237 |
| 959,952 | 5/1910 | Melen | 2/237 |
| 1,709,508 | 4/1929 | Weener et al. | 2/237 |
| 2,081,532 | 5/1937 | Fisch | 2/227 |
| 2,189,332 | 2/1940 | Spang | 2/76 |
| 2,280,416 | 4/1941 | Young | 2/227 |
| 2,349,974 | 5/1944 | McMasters | 2/227 |
| 2,434,714 | 1/1948 | Newcombe | 2/237 |
| 2,462,553 | 2/1949 | Rent | 2/76 |
| 2,581,627 | 1/1952 | Bubb | 2/237 |
| 2,661,475 | 12/1953 | Auslender | 2/221 |
| 2,674,742 | 4/1954 | Cantil | 2/237 |
| 2,755,481 | 7/1956 | Cantil | 2/237 |
| 2,917,750 | 12/1959 | Goldring | 2/221 |
| 3,040,331 | 6/1962 | Lampkowitz | 2/237 |
| 3,500,478 | 3/1970 | Foster | 2/221 |
| 3,812,541 | 5/1974 | Stuart | 2/237 |
| 4,089,068 | 5/1978 | Swallow | 2/76 |
| 4,287,611 | 9/1981 | Lundstrom | 2/237 |
| 4,677,699 | 7/1987 | Barabe | 2/221 |
| 4,800,594 | 1/1989 | Young | 2/237 |
| 4,893,358 | 1/1990 | Bice, Jr. | 2/221 |

FOREIGN PATENT DOCUMENTS

| | | | |
|---|---|---|---|
| 7136 | 1/1916 | United Kingdom | 2/76 |
| 598031 | 2/1948 | United Kingdom | 2/221 |

OTHER PUBLICATIONS

Gershman, Maurice, *Journal of AMA,* vol. 168, No. 7, Oct. 1958.

*Primary Examiner*—Werner H. Schroeder
*Assistant Examiner*—Amy Brooke Vanatta
*Attorney, Agent, or Firm*—Lerner, David, Littenberg, Krumholz & Montlik

[57] ABSTRACT

A waist adjustment mechanism for a garment enables the waist size of the garment to be easily and conveniently adjusted to accommodate the extensive range of waist sizes among individuals. The waist adjustment feature consists of a series of opposed fastening elements disposed along the interior surface of the waistband. Engagement of select ones of the opposed fastening elements reduces the waist of the garment to the desired size. When used in connection with a pair of trousers, the trousers may optionally be provided with adjustable ankle portions which facilitate the wearer in putting his foot through the ankle openings.

11 Claims, 4 Drawing Sheets

ADJUSTABLE WAIST GARMENTS

FIELD OF THE INVENTION

The present invention relates generally to garments having a waist portion such as pants, shorts, skirts and the like. More particularly, the present invention relates to such garments having an adjustable waist whereby one configuration of such garments can be readily adjusted at the waist to accommodate a range of different sizes.

BACKGROUND OF THE INVENTION

In many industries, corporations provide their employees with a standard uniform to wear. The uniforms serve not only an aesthetic function, thereby enhancing a desirable corporate image, but serve a safety function as well. For example, providing employees in the food service industry with a new uniform on a regular basis enables employers to assure the cleanliness and neat appearance of their employees.

Providing a standard uniform to employees presents employers with both cost and storage problems. Thus, in many industries there is a large turnover in personnel which requires that the uniforms always be available in a full range of sizes. This practice is not only inefficient in that uniforms in many of the sizes will not be used for a long period of time, but it requires the employer to apportion an unnecessarily large amount of money to uniform inventory.

Thus, the need exists for a garment having a large waist size adjustment to accommodate extensive variations in the waist size of employees. Preferably, the waist adjustment configuration will be of a simple construction that is easily and conveniently adjusted by the wearer with a minimum of effort. More preferably, the waist adjustment configuration will be simple and inexpensive to manufacture, thereby making it an extremely cost effective alternative to employers who otherwise would need to maintain an inventory of uniforms in a variety of different sizes.

SUMMARY OF THE INVENTION

In accordance with one aspect of the present invention, these needs have now been addressed by the invention of a garment having an improved adjustable waist portion. The garment consists of a waistband having an interior surface defining an initial waist size and an exterior surface, and fastening means on the interior surface for forming flap portions on the waistband to thereby reduce the initial waist size of the waistband to a selected waist size.

In one embodiment, the garment further consists of means for securing the flap portions against the exterior surface of the waistband. Preferably, the means for securing the flap portions against the exterior surface of the waistband consists of a pair of ribbon members disposed a spaced distance apart on the exterior surface of the waistband, whereby joining the pair of ribbon members together secures the flap portions against the exterior surface of the waistband. More preferably, the means for securing the flap portions permits the flap portions to be secured to either a front portion or a rear portion of the garment.

In preferred embodiments, the fastening means consist of a plurality of pairs of fastening members disposed at predetermined intervals on the interior surface of the waistband, whereby engagement of select ones of the plurality of pairs of fastening members determines the selected waist size. The plurality of pairs of fastening members desirably include hook and loop fasteners, snap fasteners, or a combination thereof.

Preferred embodiments of this aspect of the present invention provide a garment having an improved adjustable waist portion which enables the waist size of the garment to be readily adjusted over a wide range of sizes to thereby accommodate the substantial variation in waist size which is extant among individuals. By utilizing the mechanism of the present invention to adjust the waist size of the garment a corresponding adjustment is automatically made to the hip and thigh portion of the garment. Hence, the present invention not only permits the waist size of a garment to be adjusted quickly and conveniently, but provides a neat appearance and comfortable fit at all sizes of adjustment.

Furthermore, preferred embodiments of the present invention provide an improved waist adjustment portion which has a simple configuration which is easily incorporated into the garment and which is inexpensive to manufacture.

In accordance with another aspect of the present invention, an adjustable pair of trousers is provided consisting of a waist portion including a waistband having an interior surface defining an initial waist size and an exterior surface; fastening means on the interior surface for forming flap portions on the waistband to thereby reduce the initial waist size of the waistband to a selected waist size; a pair of leg members depending from the waist portion, each of the pair of leg members terminating in an ankle opening of a predetermined size; and means for reversibly enlarging the predetermined size of the ankle openings.

In one embodiment, the trousers further include means for securing the flap portions against the exterior surface of the waistband. Preferably, the means for securing the flap portions against the exterior surface of the waistband consist of a pair of ribbon members disposed a spaced distance apart on the exterior surface of the waistband, whereby joining the pair of ribbon members together secures the flap portions against the exterior surface of the waistband. The means for securing the flap portions preferably permit the flap portions to be secured to either a front portion or a rear portion of the garment.

In another embodiment, the fastening means consist of a plurality of pairs of fastening members disposed at predetermined intervals on the interior surface of the waistband, whereby engagement of select ones of the plurality of pairs of fastening members determines the selected waist size. The plurality of pairs of fastening members desirably include hook and loop fasteners, snap fasteners, or a combination thereof.

In yet another embodiment, the means for reversibly enlarging the predetermined size of the ankle openings consists of an open slit disposed on each of the pair of leg members and extending a predetermined distance from the ankle openings, and fastening elements for reversibly closing the open slit.

Preferred embodiments of this aspect of the present invention provide a pair of trousers which may be adjusted to fit a wide range of individual sizes, and which may be worn by both males and females. Not only do the trousers incorporate the unique waist adjustment portion of the present invention, but the size of the ankle opening may be adjusted in order to make it easier for an individual's foot to fit therethrough.

Moreover, preferred embodiments of the present invention provide a pair of trousers having a unique structure which presents an identical appearance whether the trousers are worn front to back or back to front. Not only is the back of the trousers the same as the front, but the right side is the same as the left, thereby facilitating pressing the trousers into a flat configuration.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF A PREFERRED EMBODIMENT

For the purpose of describing the features of the present invention, the adjustable waist configuration is discussed in association with a conventional pair of trousers. It will be appreciated, however, that the adjustable waist configuration of the present invention may be used in connection with a variety of garments having a waist portion, such as shorts, skirts, jumpsuits, work overalls and the like.

Figure 5:
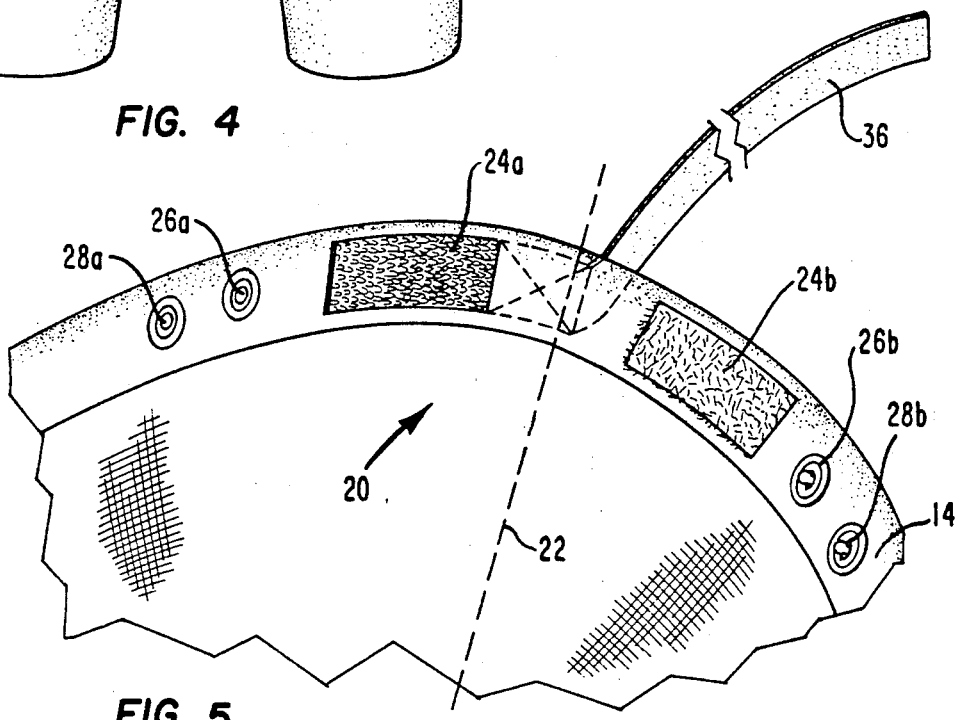
FIG. 5 is an enlarged partial view showing the fastening members on the inner surface of the waist of the trousers.

Referring to the figures, there is illustrated a pair of trousers 10 having an adjustable waist 12 in accordance with the present invention. Waist 12 is defined by a waist band 14 having an exterior surface 16 and an interior surface 18. Along a portion of waistband 14 corresponding to one side of trousers 10, interior surface 18 includes a fastening portion 20 consisting of a series of individual fastening elements. As shown more clearly in the enlarged view of FIG. 5, fastening portion 20 includes a plurality of opposed fastening elements arranged on interior surface 18 in a mirror image about fold line 22. Thus, opposed fastening elements **24*a* and 24*b* are equally spaced from fold line 22. Similarly, opposed fastening elements 26*a* and 26*b* are spaced the same distance from fold line 22, as are opposed fastening elements 28*a* and 28*b*. As shown in the figures, fastening elements 24*a* and 24*b* are formed from mating portions of a hook and loop fastener, such as VELCRO, while fastening elements 26*a* and 26*b* and 28*a* and 28*b* are formed from mating portions of a snap closure. While this arrangement of fastening elements is preferred, the present invention contemplates the use of any type of fasteners, including zippers, buttons, studs, etc., capable of securing together the portions of waistband 14 on either side of fold line 22. The present invention further contemplates the use of such fastening elements in any combination. Hence, the fastening elements may all be of a single type, such as VELCRO or snaps, or may consist of any combination of two or more types of fasteners. A fastening portion 30 is disposed on interior surface 18 on the opposite side of trousers 10 and consists of fastening elements on either side of fold line 32 which are similar to those which comprise fastening portion 20**.

A pair of ribbon members 34 and 36 are attached near fold lines 22 and 32 on the exterior surface 16 of waistband 14. As discussed more fully below, ribbon members 34 and 36 may be tied together to secure any excess portions of the waistband 14 against the exterior of the trousers after the waistband has been adjusted to the desired size.

Figure 1:
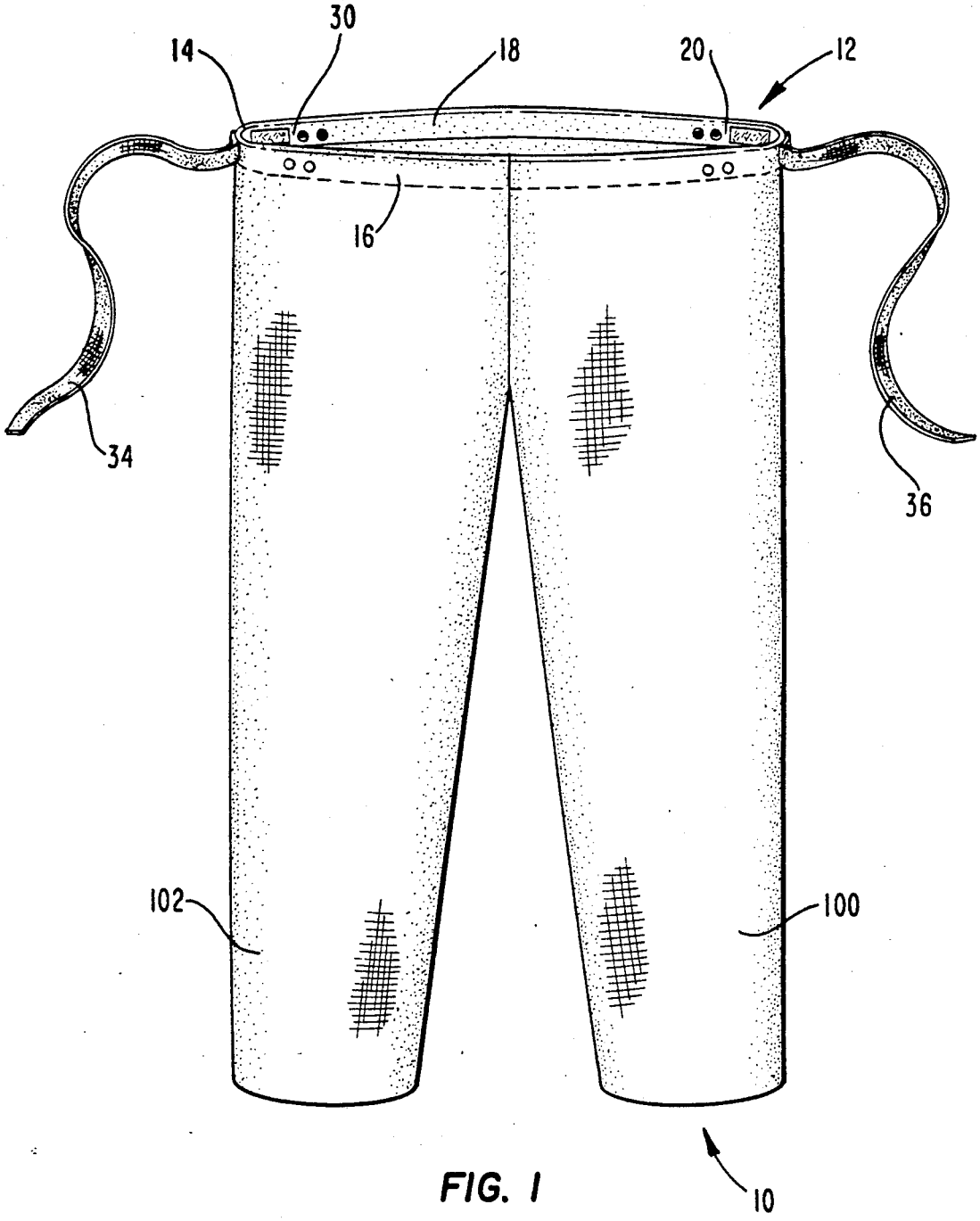
FIG. 1 is an elevational view of a pair of trousers incorporating the adjustable waist of the present invention, and showing the waist in a fully extended configuration.
Figure 2:
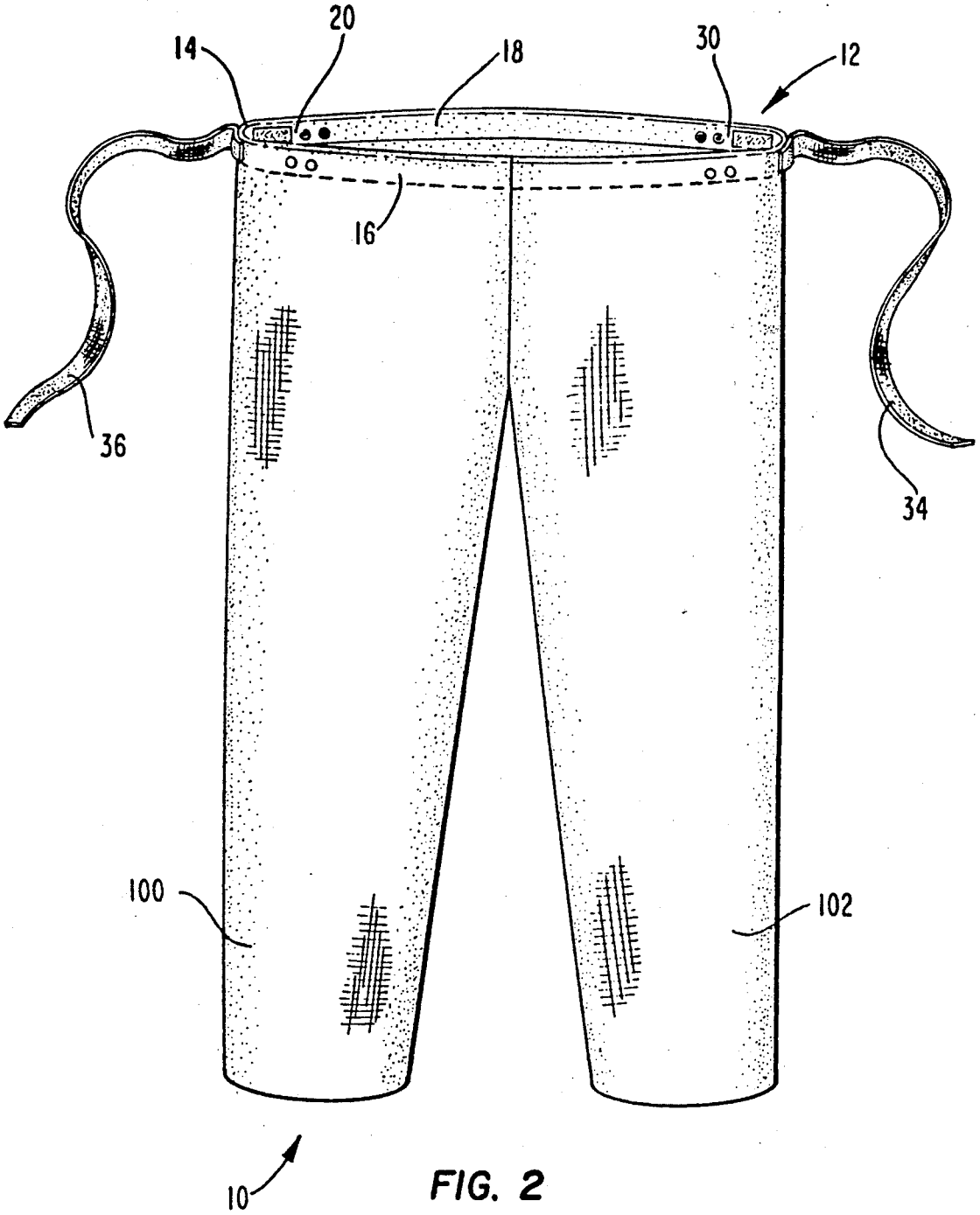
FIG. 2 is a rear elevational view of the trousers shown in FIG. 1.

The operation of the adjustable waist 12 to alter the waist size of trousers 10 in accordance with the present invention can best be understood by reference to FIGS. 1–4. As shown in FIG. 1, the largest waist size for trousers 10 is provided when waist 12 is completely unadjusted. In other words, when none of the fastening elements in portions 20 and 30 are engaged, waist 12 takes its fully expanded size. In this configuration, a wearer can easily put on trousers 10 without difficulty. Once the trousers are on, adjustable waist 12 enables the waist size to be easily and conveniently adjusted to a comfortable fit. Thus, referring to FIG. 3, the opposed fastening elements comprising fastening portions 20 and 30 are selectively and progressively engaged to diminish the waist size of the trousers 10. Thus, the first pair of opposed fastening elements, such as fastening elements **24*a* and 24*b* and the similarly situated fastening elements on the other side of the trousers, are engaged to reduce the waist size of trousers 10 by a first incremental amount. Should the waist size still be too large for the wearer, the next pair of opposed fastening elements, i.e., 26*a* and 26*b* and the corresponding pair on the opposite side of trousers 10**, are engaged to further reduce the waist size of the trousers by another incremental amount. This procedure is continued until the waist size of the trousers has been sufficiently reduced to comfortably fit the wearer.

Typically, the waist size is reduced by progressively engaging the corresponding fastening elements of portions 20 and 30 at the same time, thereby reducing the waist size of the trousers 10 by equal amounts on either side. However, in those cases where it is desirable to reduce the waist size of trousers 10 by an amount less than the reduction provided by engaging the next corresponding fastening elements of both fastening portions 20 and 30, the next opposed fastening elements on only one side of the trousers 10 may be engaged to provide an intermediate amount of waist size reduction. For instance, engaging the next pair of opposed fastening elements in only fastening portion 20 will reduce the waist size of the trousers by approximately half the amount of the waist size reduction which would result upon engaging the next pair of opposed fastening elements in both fastening portions 20 and 30.

Figure 3:
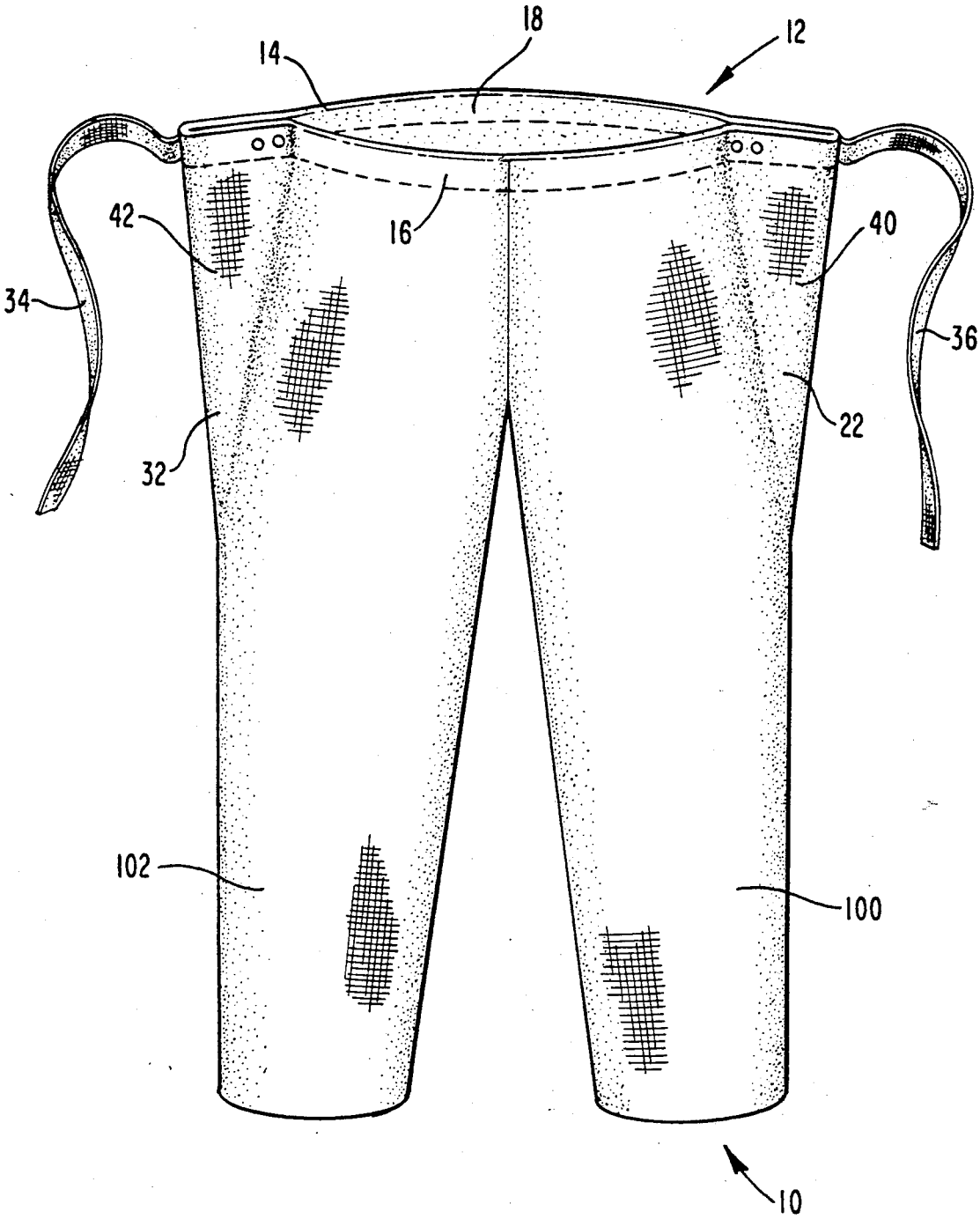
FIG. 3 is a front elevational view of the trousers shown in FIG. 1, showing the formation of flap members which reduce the waist size.
Figure 4:
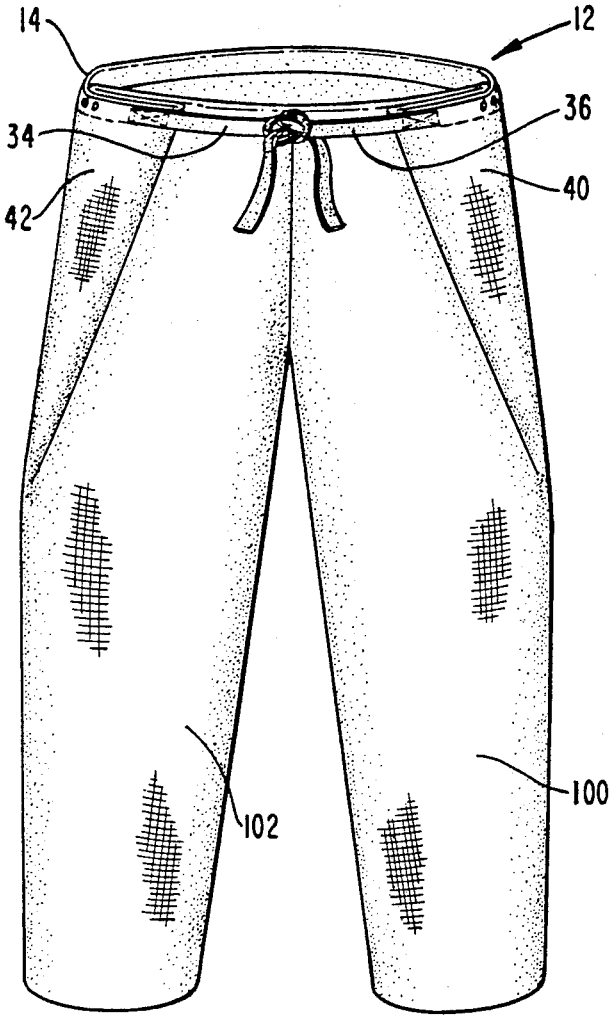
FIG. 4 is a front elevational view of the trousers of FIG. 3, with the flap portions secured against the front portion of the trousers.

As shown in FIG. 3, engagement of the opposed fastening elements on both sides of trousers 10 results in the formation of flaps 40 and 42 which extend outwardly from either side of trousers 10. By tying ribbon members 34 and 36 together, as shown in FIG. 4, flaps 40 and 42 may be secured against the front exterior surface 16 of waistband 14 to provide a neat appearance. Flap members 40 and 42 may also be secured against the rear surface of the waistband 14, if desired, by tying ribbon members 34 and 36 together in the rear of the trousers 10. Alternatively to ribbon members 34 and 36, a belt and buckle closure or any other two-point closure system may be employed for securing flap members 40 and 42 against the exterior of waistband 14. As a consequence of forming flap members 40 and 42 and securing same against the exterior surface 16 of waistband 14, not only is the waist size of trousers 10 adjusted to the desired size, but there is a corresponding adjustment in the hip and thigh portions of trousers 10 as well.

Figure 6:
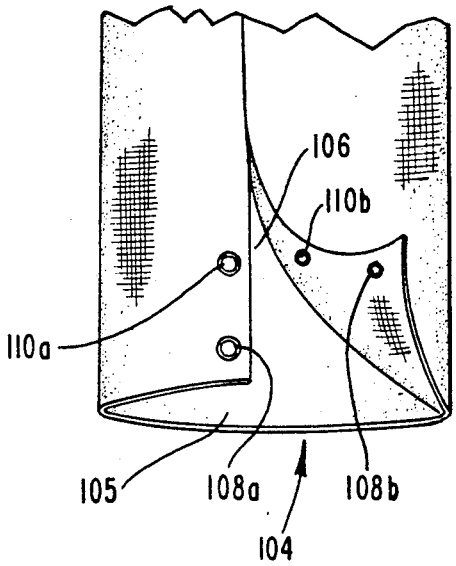
FIG. 6 is an enlarged partial view showing the adjustable ankle portion of the trousers in accordance with the present invention.

When the adjustable waist 12 is used in connection with a pair of trousers 10, the large degree of taper in the leg members 100 and 102 of the trousers may make it difficult for a wearer to put his foot through the ankle opening of the trousers. This is particularly true in those situations where trousers 10 are worn over another pair of trousers and the wearer desires to put on trousers 10 without taking off his shoes. In order to make it easier for the wearer to put his foot through the ankle openings thereof, trousers 10 may optionally be provided with adjustable ankle portions. FIG. 6 shows the adjustable ankle portion 104 on one leg of trousers 10, the adjustable ankle portion on the other leg being substantially similar thereto. Ankle portion 104 consists of a slit 106 extending from the ankle opening 105 of trousers 10 upwardly to thereby provide a larger opening for passing a foot or shoe therethrough. Opposed fasteners, such as snap elements 108*a* and 108*b*, and 110*a* and 110*b*, close slit 106 once positioned about the wearer's ankle. Although snaps are used to close slit 106 in the embodiment shown in FIG. 6, any releasable fastener may be used for this purpose, such as zippers, VELCRO, buttons and the like.

Removal of trousers 10 from the wearer can be accomplished just as easily as putting them on. Ribbon members 34 and 36 merely need to be untied and waistband 14 tugged to disengage the fastening elements in portions 20 and 30, thereby enlarging the waist size of the trousers 10. The trousers 10 may then be easily removed from the wearer. In those embodiments where trousers 10 include adjustable ankle portions, such as that exemplified by adjustable ankle portion 104, disengagement of the fasteners on the ankle portions will widen the opening at the bottom of the pants so that the wearer can easily pass his foot therethrough, either with or without his shoe thereon.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as set forth in the appended claims.

We claim:

1. A garment having an adjustable waist portion comprising, a waistband having an interior surface defining an initial waist size and an exterior surface, fastening means on said interior surface for forming flap portions on said waistband to thereby reduce said initial waist size of said waistband to a selected waist size, and connecting means for securing said flap portions against either a front portion or a rear portion of said exterior surface of said waistband.

2. A garment as claimed in claim 1 wherein said fastening means comprises a plurality of pairs of fastening members disposed at predetermined intervals on said interior surface of said waistband, whereby engagement of select ones of said plurality of pairs of fastening members determines said selected waist size.

3. A garment as claimed in claim 2 wherein said plurality of pairs of fastening members include hook and loop fasteners.

4. A garment as claimed in claim 2 wherein said plurality of pairs of fastening members include snap fasteners.

5. A garment as claimed in claim 1 wherein said connecting means comprises a pair of ribbon members disposed a spaced distance apart on said exterior surface of said waistband, whereby joining said pair of ribbon members together secures said flap portions against said exterior surface of said waistband.

6. An adjustable pair of trousers comprising, a waist portion including a waistband having an interior surface defining an initial waist size and an exterior surface, fastening means on said interior surface for forming flap portions on said waistband to thereby reduce said initial waist size of said waistband to a selected waist size, connecting means for securing said flap portions against either a front portion or a rear portion of said exterior surface of said waistband, a pair of leg members depending from said waist portion, each of said pair of leg members terminating in an ankle opening of a predetermined size, and means for reversibly enlarging said predetermined size of said ankle openings.

7. An adjustable pair of trousers as claimed in claim 6 wherein said fastening means comprises a plurality of pairs of fastening members disposed at predetermined intervals on said interior surface of said waistband, whereby engagement of select ones of said plurality of pairs of fastening members determines said selected waist size.

8. An adjustable pair of trousers as claimed in claim 7 wherein said plurality of pairs of fastening members include hook and loop fasteners.

9. An adjustable pair of trousers as claimed in claim 7 wherein said plurality of pairs of fastening members includes snap fasteners.

10. An adjustable pair of trousers as claimed in claim 6 wherein said connecting means comprises a pair of ribbon members disposed a spaced distance apart on said exterior surface of said waistband, whereby joining said pair of ribbon members together secures said flap portions against said exterior surface of said waistband.

11. An adjustable pair of trousers as claimed in claim 6 wherein said means for reversibly enlarging said predetermined size of said ankle openings comprises, an open slit disposed on each of said pair of leg members and extending a predetermined distance from said ankle openings, and fastening elements for reversibly closing said open slit.

* * * * *